US007552688B2

(12) United States Patent
Lundell

(10) Patent No.: US 7,552,688 B2
(45) Date of Patent: Jun. 30, 2009

(54) METHOD AND APPARATUS FOR CONVERTING ANIMAL WASTE INTO BEDDING OR SOIL AMENDMENT

(76) Inventor: John H. Lundell, 425 Orchard Ridge Rd., Dodgeville, WI (US) 53533

( * ) Notice: Subject to any disclaimer, the term of this patent is extended or adjusted under 35 U.S.C. 154(b) by 354 days.

(21) Appl. No.: 11/360,265

(22) Filed: Feb. 23, 2006

(65) Prior Publication Data

US 2007/0193063 A1 Aug. 23, 2007

(51) Int. Cl.
*F23B 7/00* (2006.01)

(52) U.S. Cl. ..... 110/233; 110/224

(58) Field of Classification Search ..... 110/226, 110/221, 233; 34/312, 425, 591, 592
See application file for complete search history.

(56) References Cited

U.S. PATENT DOCUMENTS 2,213,667 A * 9/1940 Dundas et al. ..... 110/220
3,701,727 A * 10/1972 Kormanik ..... 210/605
3,744,145 A 7/1973 Maxwell et al.
3,789,797 A * 2/1974 Brewer ..... 119/173
3,800,429 A * 4/1974 Lindl ..... 34/79
4,241,515 A * 12/1980 Wochnowski et al. ..... 34/474
4,359,006 A 11/1982 Have
4,683,814 A 8/1987 Plovanich et al.
5,052,313 A * 10/1991 Walker ..... 110/346
5,195,465 A * 3/1993 Webb et al. ..... 119/172
6,141,905 A 11/2000 Rozental et al.
6,149,694 A 11/2000 Redden, Jr. et al.
6,224,771 B1 5/2001 Takeshima
6,367,395 B1 4/2002 Masek
6,425,933 B1 7/2002 McDaniel et al.
6,773,595 B2 * 8/2004 Gantzer ..... 210/605
6,811,701 B2 11/2004 Wilkie
2004/0065127 A1 4/2004 Connell
2005/0249632 A1 11/2005 Garrett et al.

* cited by examiner

*Primary Examiner*—Kenneth B Rinehart
(74) *Attorney, Agent, or Firm*—Lathrop & Clark LLP

(57) ABSTRACT

Disclosed are systems and processes for drying livestock manure to produce suitable end-products such as animal bedding and soil conditioner or amendments. Dried manure made by the process can be recycled into the burner. Exhaust gases from the dryer and cyclone can be cleansed of particulate and/or used to heat and aerate trenches and/or lagoons used to digest wet manure. Biomass may also be used as fuel in the burner. Biomass may also be blended with wet manure to decrease water content prior to being dried in the dryer.

10 Claims, 2 Drawing Sheets

METHOD AND APPARATUS FOR CONVERTING ANIMAL WASTE INTO BEDDING OR SOIL AMENDMENT

FIELD OF THE INVENTION

The present invention is in the field of handling and treating animal wastes. In particular, the invention relates to processing manure into animal bedding material, soil amendments or conditioners. The field also includes processing equipment and systems for processing manure into products having commercial value.

BACKGROUND OF THE INVENTION

Over the years, there has been a variety of approaches to treating and disposing of livestock manure as well as mediating disagreeable odor generated from livestock manure. The increased scrutiny is due in part to or as a result of a well-known recent trend toward higher concentrations of livestock. As a result, land, water and other natural resources must be better utilized to accommodate and sustain higher concentrations of livestock.

In 2003, the Environmental Protection Agency (EPA) estimated that there were 1.3 million farms in the U.S. maintaining livestock. About 238,000 of these farms were considered to be Animal Feeding Operations (AFOs). AFOs produce more than 500 million tons of animal manure that, when improperly managed, poses substantial risks to the environment and public health. More recently, however, problems associated with livestock manure have become more challenging due to increased environmental and other regulatory scrutiny.

Also in 2003, the EPA issued final rules revising and clarifying regulatory requirements for Concentrated Animal Feeding Operations (CAFOs) pursuant to the Clean Water Act. (33 USC § 1251(a))(40 CFR Parts 9, 122, 123 and 412). These rules seek to ensure that CAFO's act to manage manure more effectively and protect the nation's water quality. At present, the EPA estimates that there are 15,500 CAFOs managing 300 million tons of manure produced annually. CAFOs often have insufficient land to effectively use the manure as fertilizer. That trend coincides with increased reports of large-scale discharges from CAFOs as well as continued nutrient runoff impairing U.S. water bodies. Interestingly, the EPA also estimates that confined farm animals generate 3 times more raw waste than is generated by humans in the U.S.

The EPA's new regulatory program covering the large CAFO operations (which present the greatest potential risk to water quality) is consistent with the Unified National Strategy for Animal Feeding Operations jointly developed by the EPA and the U.S. Department of Agriculture (USDA). The strategy defines a national objective for all AFOs to develop a comprehensive nutrient management plan to minimize impact on water quality and public health.

Despite improvements in water quality since passage of the Clean Water Act, nearly 40% of the Nation's assessed waters remain impaired. The EPA has determined that manure from CAFO's is a significant contributor to the remaining water quality problems. Put simply, improperly managed manure has caused serious chronic and acute water quality problems throughout the U.S.

The new rules strengthen the existing regulatory program relating to CAFO's by establishing a mandatory duty to apply for a permit pursuant to the National Pollutant Discharge Elimination System (NPDES)(42 CFR § 122) and the Effluent Limitations Guidelines and Standards (ELGs) for CAFOs (42 CFR § 412). To obtain the NPDES permit, the CAFO must develop and implement a nutrient management plan in compliance with effluent guidelines that set forth performance expectations for existing and new sources. The performance expectations address appropriate manure storage and proper land application practices for CAFOs. The management plan also identifies site-specific actions to be taken by the CAFO to ensure proper and effective manure and wastewater management.

In the past, livestock manure has been treated by anaerobically digesting raw livestock manure. In this process, a mixed culture of bacteria mediates the degradation of the putrescible fraction of organic matter ultimately to methane, carbon dioxide and mineralized nutrients. However, volatile intermediate compounds are also produced that have a foul odor. Another known method uses a fixed film digester design for anaerobic digestion of flushed livestock manure, whereby a biofilm allows effective treatment of wastewater at ambient and elevated temperatures as well as at reasonable hydraulic retention times.

Other systems combust animal waste to avoid releasing objectionable odor and produce dry ash that can be used as fertilizer. Another known system extracts heat energy from manure and other wet waste by combusting waste that had been dried, whereby the waste material is combusted to ash. Yet another known system makes fuel from livestock, industrial and agricultural waste and other biomass wastes, whereby the waste materials are blended and formed into fuel pellets without the need for mechanical or drying processes.

Others have designed processes for sterilizing, dewatering and micronizing organic and biomass waste streams to produce liquid or granular fertilizer, and similar systems for drying, deodorizing, sterilizing and pulverizing animal waste and manure to produce fertilizer. Still other systems compress (i.e., dewatering) and/or bio-digest various biomasses, manure and various sludge or slurries, whereby opposing rollers and a friction-inducing differential are used to produce organic fertilizer or soil conditioner.

Another known system makes organic fertilizer pellets from raw manure using cyclones that generate high-velocity air streams to pulverize and dry the raw manure. Another known system recycles organic household and restaurant waste to produce a pro-ferment, whereby the pro-ferment is mixed with animal waste to compost fermentation. Another known system manufactures artificial soil, soil conditioner, peat substitute or hygienic bedding material for livestock from animal excrement whereby the manure is deodorized, sterilized and rendered porous by subjecting the manure to an alternating current in a reactor.

It is well known in the art that livestock manure is problematic. For example, odor generated by large concentrations of manure is offensive and noxious. Disposal of livestock manure is also problematic for environmental safety reasons such as: erosion control, manure storage, runoff control, nutrient management, water/wetland protection, land runoff pollution, phosphorous and nitrogen emission reduction, and EPA regulations concerning CAFOs. Thus, it is highly advantageous to treat livestock manure in such a way as to avoid or minimize emitting odor and to avoid significant disposal. Prior attempts have been made to dry and combust manure. However, there remains a need to convert animal manure into useful end-products in new and more effective ways.

SUMMARY OF THE INVENTION

One aspect of the invention is a system for processing manure. The system includes a hopper adapted to blend and meter a manure feedstock to a dryer having a cyclone adapted to vent exhaust and discharge dried manure solids. The system may also include a wet scrubber and/or an oxidation trench each adapted to remove particulate from the exhaust. The system may further include one or more lagoons each adapted to receive waste water from the scrubber and/or exhaust from the cyclone. The system still further includes a furnace adapted to provide heat to the dryer.

In the present system, the manure feedstock may be metered by the hopper to the dryer at a steady state. The system may still further include a screen press adapted to reduce the moisture content of wet manure producing a pressed wet manure product. The manure feedstock may include the pressed wet manure product and a biomass, wherein the biomass is dried manure, sawdust, ground bean straw, ground corn stover, peat moss, paper mill sludge, ground switch grass or the like or mixtures thereof. The manure feedstock may also include some wet manure. The dryer may be a rotary drum, a fluidized bed, a steam tube or a flash dryer.

Another aspect of the invention includes a process for converting a manure feedstock into suitable livestock bedding product or suitable soil amendment/conditioner. The process includes providing a manure feedstock having a water content and drying the manure feedstock generating suitable livestock bedding product or suitable soil amendment/conditioner and an exhaust. The manure feedstock may be dried at a temperature in the range of 600-900° F. The process may also include scrubbing the dryer/cyclone exhaust to remove particulate matter generating a clean exhaust and warm waste water. The process may still further include heating and aerating one or more lagoons and/or one or more trenches (each adapted to digest wet manure) with the warm waste water and with the particulate-containing and/or clean exhausts.

The process may also include screen pressing a wet manure producing a pressed wet manure product, wherein the water content of the wet manure is about 80-85%, and wherein the water content of the pressed wet manure product is around 70-72%. The livestock bedding or soil amendment/conditioner end-products may have a moisture content of about 5%.

The process may also include blending a biomass with the wet manure and/or the pressed wet manure product, wherein the biomass is dried manure, sawdust, ground bean straw, ground corn stover, peat moss, paper mill sludge, ground switch grass or the like or mixtures thereof. Still further, the process may include burning dried manure and/or biomass to provide heat to the dryer.

These and other individual features and advantages of the invention are described in or apparent from the following detailed description. The features and advantages may be separately incorporated in various exemplary embodiments of systems and methods set forth herein.

DETAILED DESCRIPTION OF THE EXEMPLARY EMBODIMENTS

Figure 1:
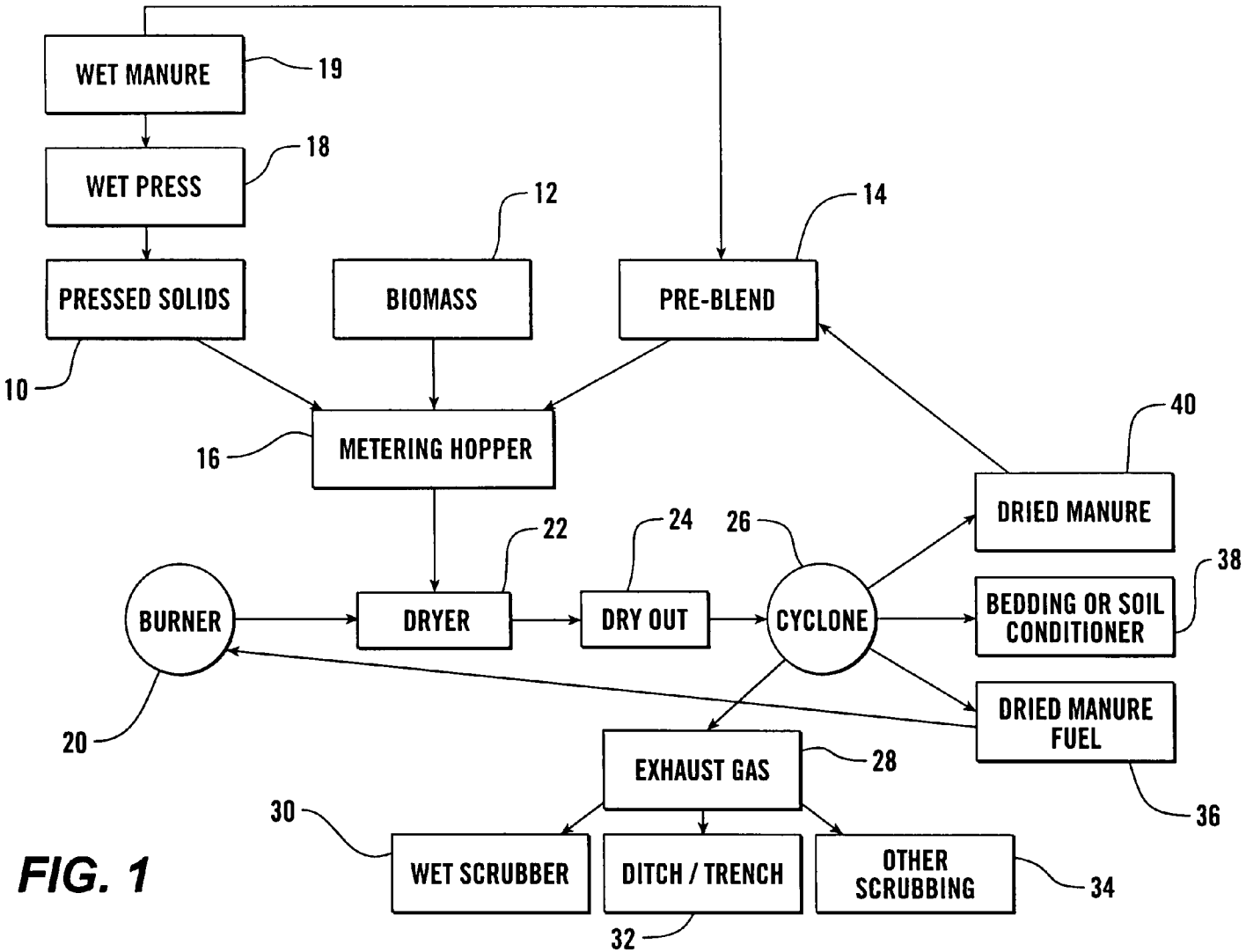
FIG. 1 shows a schematic diagram of one aspect of the present invention whereby various feed manure and materials are blended, pressed and dried to produce various end-products.

An exemplary embodiment of the present invention is shown in FIG. 1 whereby wet manure 19 is fed to a wet press 18. The wet press 18 may include an auger operated by 10 hp motor. An exemplary press is one manufactured by Vincent Company of Tampa Bay, Fla., Vincent Model KP-10, and Fann Manure Separator Model PSS.

The wet manure 19 may have a water content over 80%. The wet press 18 reduces the water content of the wet manure 19 to around 70-72%. The pressed solids 10 are transferred from the wet press 18 to a metering hopper 16. For example, the pressed solids 10 may be conveyed by a wheeled loader, screw conveyor or a belt conveyor. There, the pressed solids 10 can be blended with a biomass 12 such as sawdust, ground bean straw, corn fodder, ground corn stover, peat moss, paper mill sludge, ground switch grass, straw or the like or mixtures thereof to produce a manure feedstock.

The pressed solids 10 and/or biomass 12 may be further blended with a stream of dried manure 40 in the metering hopper 16 to produce another manure feedstock. Vertical storage bins may be used to store the biomass 12 and/or the dried manure end-products 36, 38, 40. Wet manure 19 may be pre-blended with dried manure 40 prior to being fed into the metering hopper 16 whereby the pre-blended wet/dry manure 14 may also be stored in vertical storage bins. Wet manure 19 having a moisture content below around 50% can be transferred directly to the dryer 22. Alternatively, wet manure 19 may be fed directly to the metering hopper 16 where the water content of the wet manure 19 is less than about 72%.

The dried manure end-products 36,38,40 may have a water content of around 5-40% The biomass 12 may have a water content of around 20% to 50%. The wet manure and dried manure blend 14 may have a water content of around 30% to 60%. In an exemplary embodiment of the invention, the pressed solids 10 are blended with biomass 12 and wet/dried manure 14 such that the moisture content of the material in the wet product metering hopper is around 30% to 50%. The raw material metering hopper 16 may be used to blend and contain the pressed solids 10, the biomass 12 and the wet/dried manure blend 14. The hopper 16 may include a speed-actuated motor and auger or belt conveyor to convey the material contained therein to the dryer 22. It is important to control and adjust the water content of the material in the hopper 16 in order to achieve efficient operation of the burner 20 and dryer 22. An exemplary furnace is the Energy Unlimited model 15RI5 Biomass furnace. An exemplary metering hopper is the Kuhn Knight Reel Auggie Stationary TMR Mixer series 3100. An exemplary dryer is the Heil model 9030 three-pass rotary drum dryer.

The dryer may be operated at around 600-1000° F. or at around 800-900° F. A burner 20 generates heat that is ducted to the dryer 22 to dry the wet product manure feedstock metered from the hopper 16 generating dried solids. The burner furnace 20 may be operated at a temperature in the range of about 1200-1400° F. or at about 1300° F. The burner furnace 20 may be constructed from 4½inch fire brick in the interior and 1 inch board for insulation. Dry sawdust or another suitable biomass may be used to start the furnace burner 20. The wet product manure feedstock from the hopper 16 may reside within the dryer for 2-5 minutes. In some applications, the pressed manure feedstock from the hopper 16 resides in the dryer for around 3 minutes.

The fuel used in the burner 20 may comprise various combustible materials. In an exemplary embodiment, the fuel comprises dried end-product 36. The fuel may further comprise various biomass materials such as sawdust, ground bean straw, corn fodder, ground corn stover, peat moss, paper mill sludge, ground switch grass, straw or the like or mixtures thereof. Various fuels are generally chosen such that the moisture content is less than around 10%.

The dried solids are transferred to a dry out 24 where tramp metal and large rocks are removed from the dried solids. The dried solids are then transferred to a cyclone 26 where solid end-product is generated in the form of solids to be blended with feed wet material 40, bedding 38 and fuel 36 to be transferred to the burner 20. The moisture content of the end-products 36,38,40 can be around 5% to 40%. In some applications, the moisture content of the end-products 36,38, 40 is around 5%. The end-product 36, 38, 40 may be discharged at around 200° F.

The cyclone 26 may include a collector air lock and fan to exhaust gases 28 to the wet scrubber 30, the water oxidation ditch/trench 32 and/or to other scrubbing equipment 34 such as a thermal oxidizer. The trench 32 may be constructed from concrete and be 24 inches wide by 52 inches deep by 400 feet in length. The trench 32 may further include water sprayers spaced along the length of the trench every 50-100 feet. The exhaust gases 28 may be discharged into the trench 32 through a hole at the inlet of the trench 32. The temperature of the exhaust gases is in the range of around 180-225° F. The concrete trench advantageously reduces dust and other particulates released in the exhaust gases 28.

The exhaust gases 28 may also be discharged into one or more aerobic digesting lagoons. In an exemplary embodiment, the system includes three lagoons. Heat and aeration provided by the exhaust gases 28 may also be directed into lagoons and/or the trench 32 to aid in the aerobic digesting process. Each lagoon may be around 5 million gallons in volume. For some large-scale commercial applications, up to 3 lagoons are connected in series to digest raw manure whereby the last lagoon in the series would discharge clear effluent.

Figure 2:
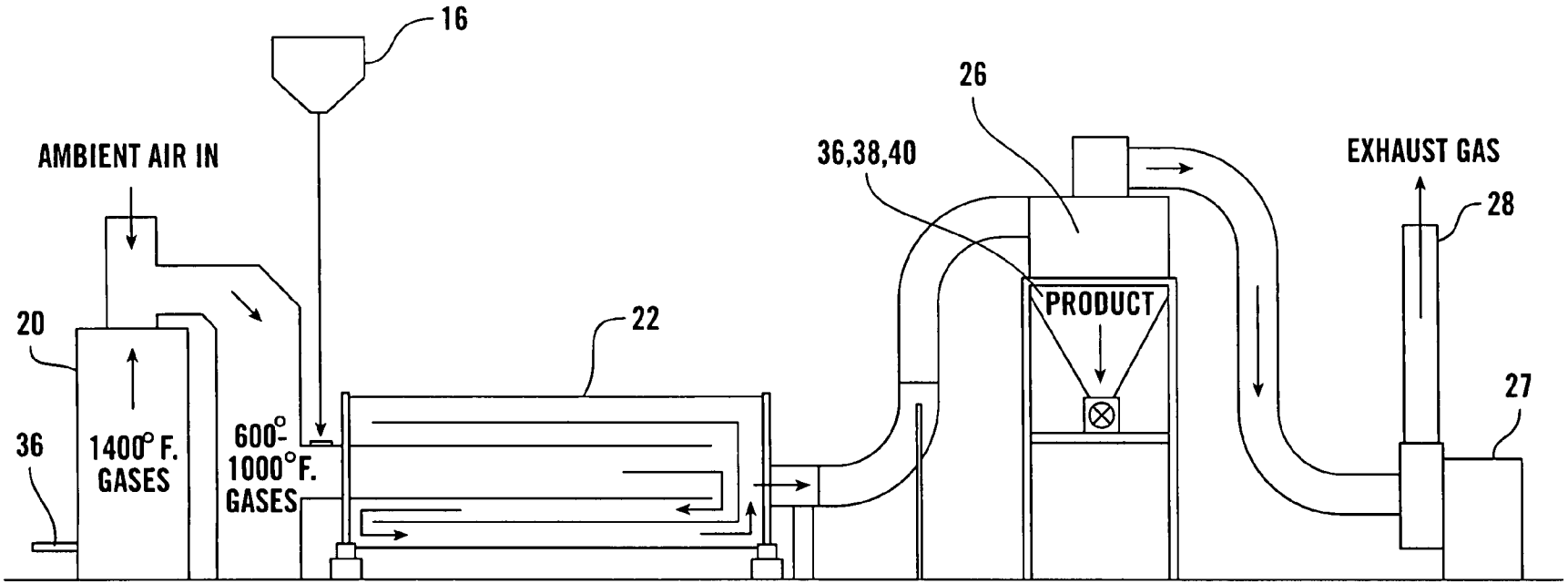
FIG. 2 shows a schematic diagram of another aspect of the present invention whereby various processing equipment is arranged to dry manure and separate the dried solid product from exhaust gases.

In another exemplary embodiment, as shown in FIG. 2, the burner 20 provides 1400° F. gas to mix with incoming ambient or conditioned air to produce gas having a temperature of around 600° F. to 900° F. or 1000° F. for the dryer 22. Manure product is fed into the dryer 22. Dried manure product is transferred from the dryer 22 to the cyclone 26 whereby end-products is discharged from the bottom of the cyclone and exhaust gases 28 are discharged from the top of the cyclone 26. Exhaust gas 28 is further transferred to the wet scrubber 30, trench 32 or other scrubbing equipment 34 by a blower 27.

While this invention has been described in conjunction with various exemplary embodiments set forth herein, the invention includes alternatives, modifications, variations, improvements and/or equivalents that are apparent or foreseeable to the ordinary artisan. Accordingly, the exemplary embodiments set forth herein are non-limiting and illustrative. Changes may be made to the exemplary embodiments within the scope of the invention without departing from the spirit of the invention. The invention, therefore, embraces suitable relevant earlier known alternatives, modifications, variations, improvements and substantial equivalents, conventional or otherwise.

I claim:

1. An apparatus for processing manure comprising:

a hopper adapted to meter a manure feedstock, a dryer adapted to dry said manure feedstock received from the hopper and having a dryer input air temperature in the range of between about 600-1000° F., a cyclone adapted to receive drying air and dried manure from the dryer, and to separate and discharge dried manure product, and vent exhaust gases and any entrained dust and other particulates, a furnace adapted to burn dried manure discharged from the cyclone at a temperature in the range of about 1200-1400° F. and provide heated gas to the dryer as required, an ambient air supply duct for providing ambient air to mix with the high temperature furnace output gas to provide the required input air to the dryer, one or more members selected from the group consisting of a wet scrubber and an oxidation trench each adapted to remove particulate from the exhaust, one or more lagoons each adapted to receive warm waste water product from one or more of the scrubber, the oxidation trench and/or exhaust from the cyclone to aid in aerobic digestive process, and a blower for drawing air through the dryer and the cyclone and transferring exhaust gas to at least one of the wet scrubber, oxidation trench or lagoon, wherein at least one portion of the dried manure product additionally comprises at least one of a suitable livestock bedding product, a suitable soil amendment/conditioner product, and a suitable dry manure product to be blended with at least one of wet manure feedstock and/or a biomass to provide a manure feedstock having a water content of around 30% to 50%.

2. The apparatus of claim 1, wherein the manure feedstock is metered at a steady state.

3. The apparatus of claim 1, further including a screen press adapted to reduce moisture content of a wet manure producing a pressed wet manure product.

4. The apparatus of claim 3, wherein the hopper is further adapted to blend the manure feedstock, and wherein the manure feedstock comprises the pressed wet manure product and a biomass selected from the group consisting of dried manure, sawdust, ground bean straw, ground corn stover, peat moss, paper mill sludge, ground switch grass and mixtures thereof.

5. The apparatus of claim 1, wherein the dryer is a member selected from the group consisting of rotary drum, fluidized bed, steam tube and flash dryer.

6. A process for converting a livestock manure feedstock into a plurality of desirable end products comprising the steps of:

providing a manure feedstock having a water content, and drying the manure feedstock in a dryer having a dryer input air temperature in the range of between about 600-1000°F., transferring drying air and dried manure from the dryer to a cyclone to separate and discharge dried manure product and a first exhaust product, burning a portion of said dried manure product discharged from the cyclone in a burner at a temperature in the range of about 1200-1400° F., mixing ambient air with the high temperature output gas from the burner to provide a gas mixture at the temperature required by the dryer and transferring the mixture to the dryer as required to dry the manure feedstock, scrubbing at least a portion of the first exhaust product to remove particulate matter generating a second exhaust and warm waste water, and/or heating and aerating one or more oxidation trenches and/or one or more lagoons, each adopted to digest manure, with at least one of the warm waste water and the first exhaust product and/or second exhaust, selecting at least a portion of the dried manure product for at least one of a suitable livestock bedding product, a suitable soil amendment/conditioner product and a suitable dry manure product to be blended with at least one of wet manure feedstock and/or biomass to provide a manure feedstock having a water content of at least around 30% to 50%.

7. The process of claim 6, further including the step of screen pressing wet manure producing pressed wet manure, wherein the water content of the wet manure is about 80-85% , and wherein the water content of the pressed wet manure is less than about 72%.

8. The process of claim 7, further comprising the step of:

blending a biomass with the pressed wet manure, wherein the biomass is selected from the group consisting of dried manure, sawdust, ground bean straw, ground corn stover, peat moss, paper mill sludge, ground switch grass and mixtures thereof.

9. The process of claim 8, further including the step of burning dried manure and/or a biomass.

10. The process of claim 6, wherein the livestock bedding product has a moisture content of about 5%.

* * * * *